US007976345B2

(12) United States Patent
Szczesny

(10) Patent No.: US 7,976,345 B2
(45) Date of Patent: Jul. 12, 2011

(54) ELECTRICAL CONTACT ASSEMBLY AND METHOD OF MANUFACTURING THEREOF

(75) Inventor: David Stanley Szczesny, Hershey, PA (US)

(73) Assignee: Tyco Electronics Corporation, Middletown, PA (US)

( * ) Notice: Subject to any disclaimer, the term of this patent is extended or adjusted under 35 U.S.C. 154(b) by 1063 days.

(21) Appl. No.: 11/304,235

(22) Filed: Dec. 15, 2005

(65) Prior Publication Data

US 2007/0141913 A1 Jun. 21, 2007

(51) Int. Cl.
*H01R 24/00* (2011.01)

(52) U.S. Cl. ..... 439/637

(58) Field of Classification Search ..... 439/885, 439/636, 637

See application file for complete search history.

(56) References Cited

U.S. PATENT DOCUMENTS 3,915,543 A * 10/1975 Pfeifer ..... 439/679
4,045,869 A * 9/1977 Hartmann et al. ..... 29/884
4,593,463 A * 6/1986 Kamono et al. ..... 29/884
4,619,495 A * 10/1986 Sochor ..... 439/637
4,865,562 A * 9/1989 Burg et al. ..... 439/395
5,236,375 A * 8/1993 Kachlic ..... 439/607
6,071,152 A * 6/2000 Achammer et al. ..... 439/733.1
6,287,132 B1 9/2001 Perino et al.

FOREIGN PATENT DOCUMENTS

DE 20 2005 009919 U1 10/2005

* cited by examiner

*Primary Examiner* — T C Patel
*Assistant Examiner* — Travis Chambers

(57) ABSTRACT

An electrical connector assembly is disclosed which includes a housing; and a plurality of substantially identical contact assemblies each including a pair of electrical contacts with receptacle contact portions configured to be received by the housing. The plurality of contact assemblies are arranged in sequence in a linear array in the housing, and in alternating first and second orientations. The second orientation is a reverse orientation with respect to the first orientation. The substantially identical electrical contact assemblies each include a first electrical contact and a second electrical contact and a receptacle contact portion in electrical communication with the edge connector portion. The edge connector portions are substantially a mirror image while the receptacle contact portions are substantially slide-along images of each other. A method of manufacturing is also disclosed for the electrical contact assemblies.

9 Claims, 9 Drawing Sheets

ELECTRICAL CONTACT ASSEMBLY AND METHOD OF MANUFACTURING THEREOF

BACKGROUND

1. Technical Field

The present disclosure relates to electrical contact assemblies and, more particularly, to electrical contact assemblies for electrical connectors configured so as to reduce manufacturing costs.

2. Discussion of Related Art

Electrical connectors for applications such as mating to an edge of a printed circuit board must contain numerous electrical contacts. Therefore, the cost of manufacturing an electrical connector is driven by the cost of manufacturing and inserting the electrical contacts into the housing of the electrical connector.

A need exists for an electrical contact assembly which can be inserted in numerous quantities into an electrical connector, both of which are configured to reduce manufacturing and assembly costs.

SUMMARY

The present disclosure relates to an electrical contact assembly which can be inserted in numerous quantities into an electrical connector, both of which are configured to reduce manufacturing and assembly costs.

The present disclosure also relates to an electrical connector assembly which includes a housing and a plurality of substantially identical contact assemblies arranged in a linear array and in a reverse alternating sequence within the housing such that each successive contact assembly in the array has a reverse orientation with respect to an immediately preceding contact assembly.

In one embodiment, an electrical contact assembly includes a first electrical contact and a second electrical contact. The first electrical contact has an edge connector portion, and a receptacle contact portion in electrical communication with the edge connector portion. Similarly, the second electrical contact has an edge connector portion, and a receptacle contact portion in electrical communication with the edge connector portion. The edge connector portion of the first electrical contact is substantially a mirror image of the edge connector portion of the second electrical contact, while the receptacle contact portion of the first electrical contact is substantially a slide-along image of the receptacle contact portion of the second electrical contact. The first and second electrical contacts may each include an extending portion extending from the edge connector portion, with the extending portion providing the electrical communication between the edge connector portion and the receptacle contact portion. The extending portion of the first electrical contact may be substantially a mirror image of the extending portion of the second electrical contact. The electrical contact assembly may further include a joining member joining the first electrical contact to the second electrical contact. The joining member may further include a recess for mating to a surface of the housing of the electrical connector.

In another embodiment, an electrical connector assembly includes a housing which is configured to receive at least one set of substantially identical electrical contact assemblies arranged in a linear array and in a reverse alternating sequence within the housing such that each successive contact assembly in the array has a reverse orientation with respect to an immediately preceding contact assembly. In one embodiment, the housing includes at least one set of the substantially identical electrical contact assemblies arranged in a linear array and in a reverse alternating sequence within the housing such that each successive contact assembly in the array has a reverse orientation with respect to an immediately preceding contact assembly. Each contact assembly may include a pair of electrical contacts with receptacle contact portions configured to be received by the housing.

The substantially identical electrical contact assemblies may each include a first electrical contact and a second electrical contact. The first electrical contact may have an edge connector portion, and a receptacle contact portion in electrical communication with the edge connector portion. Similarly, the second electrical contact may have an edge connector portion, and a receptacle contact portion in electrical communication with the edge connector portion. The edge connector portion of the first electrical contact is substantially a mirror image of the edge connector portion of the second electrical contact, while the receptacle contact portion of the first electrical contact is substantially a slide-along image of the receptacle contact portion of the second electrical contact. The first and second electrical contacts may each include an extending portion extending from the edge connector portion. The extending portion provides the electrical communication between the edge connector portion and the receptacle contact portion. The electrical connector assembly may further include a joining member joining the first electrical contact to the second electrical contact. The joining member may further include a recess for mating to a surface of the housing.

The housing may be configured to receive the plurality of substantially identical electrical contact assemblies via an array of partitioned electrically insulating adjacent compartments. The electrical connector assembly includes the housing holding a plurality of the identical contact assemblies arranged in a linear array and in a reverse alternating sequence such that each successive contact assembly in the array has a reverse orientation with respect to an orientation of an immediately preceding contact assembly.

The housing may include first and second apertures providing accessibility to the array of compartments. The compartments of the array may be configured to expose the receptacle contact portions of the first and second electrical contacts at the first aperture. The plurality of contact assemblies being arranged in a linear array and in a reverse orientation with respect to the orientation of an immediately preceding contact assembly may expose the receptacle contact portions of the electrically contact assemblies in a staggered configuration with respect to the immediately preceding contact assembly. The compartments of the array may be configured to expose the edge connector portions of the first and second electrical contacts at the second aperture. The present disclosure relates also to a method of manufacturing an electrical contact assembly. The method includes the steps of: providing a carrier strip, and stamping the carrier strip to form at least a first electrical contact assembly. The at least first electrical contact assembly includes a first electrical contact and a second electrical contact. The first electrical contact has an edge connector portion, and a receptacle contact portion in electrical communication with the edge connector portion. Similarly, the second electrical contact has an edge connector portion, and a receptacle contact portion in electrical communication with the edge connector portion. The edge connector portion of the first electrical contact is substantially a mirror image of the edge connector portion of the second electrical contact, while the receptacle contact portion of the first electrical contact is substantially a slide-along image of the receptacle contact portion of the second electrical contact. The first and second electrical contacts may each include an extending portion extending from the edge connector portion, the extending portion providing the electrical communication between the edge connector portion and the receptacle contact portion. The extending portion of the first electrical contact is substantially a mirror image of the extending portion of the second electrical contact. The method of manufacturing may further include the step of joining the first electrical contact together with the second electrical contact to form the at least first electrical contact assembly. The step of joining the first electrical contact together with the second electrical contact may be implemented by forming an overmolding over the first and second electrical contacts.

DETAILED DESCRIPTION

Figure 1:
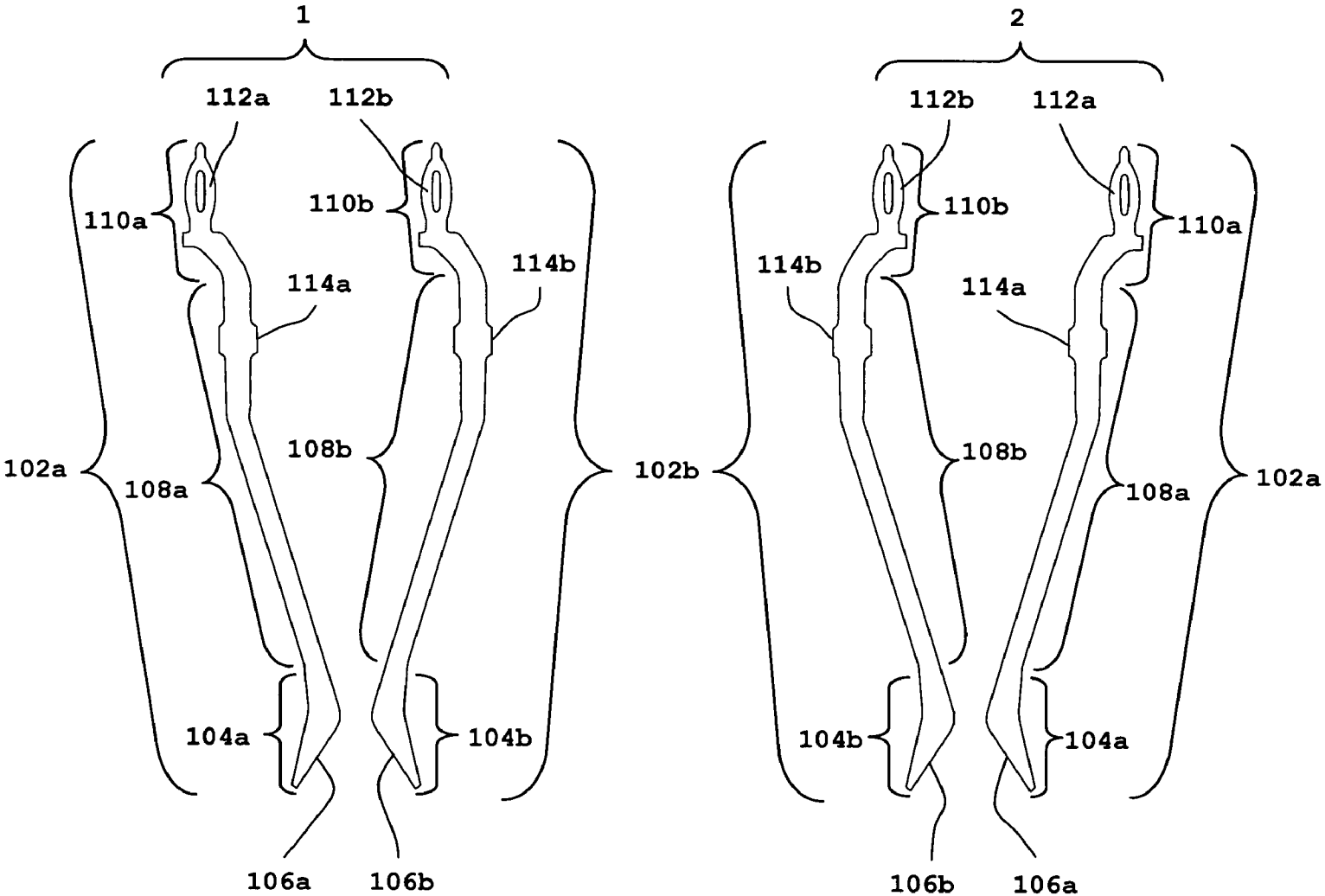
FIG. 1 is a side view of two pairs of electrical contacts for a set of electrical contact assemblies according to the present disclosure.

The present disclosure will be understood more fully from the detailed description given below and from the accompanying drawings of particular embodiments of the disclosure which, however, should not be taken to limit the disclosure to a specific embodiment but are for explanatory purposes.

Numerous specific details may be set forth herein to provide a thorough understanding of a number of possible embodiments of the present disclosure. It will be understood by those skilled in the art, however, that the embodiments may be practiced without these specific details. In other instances, well-known methods, procedures, components and circuits have not been described in detail so as not to obscure the embodiments. It can be appreciated that the specific structural and functional details disclosed herein may be representative and do not necessarily limit the scope of the embodiments.

Some embodiments may be described using the expression "coupled" and "connected" along with their derivatives. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments disclosed herein are not necessarily limited in this context.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Embodiments of the presently disclosed electrical connector will now be described in detail with reference to the drawing figures wherein like reference numerals identify similar or identical elements. As used herein and as is traditional, the term "distal" refers to that portion which is furthest from the user while the term "proximal" refers to that portion which is closest to the user. In addition, terms such as "above", "below", "forward", "rearward", etc. refer to the orientation of the figures or the direction of components and are simply used for convenience of description.

Figure 2:
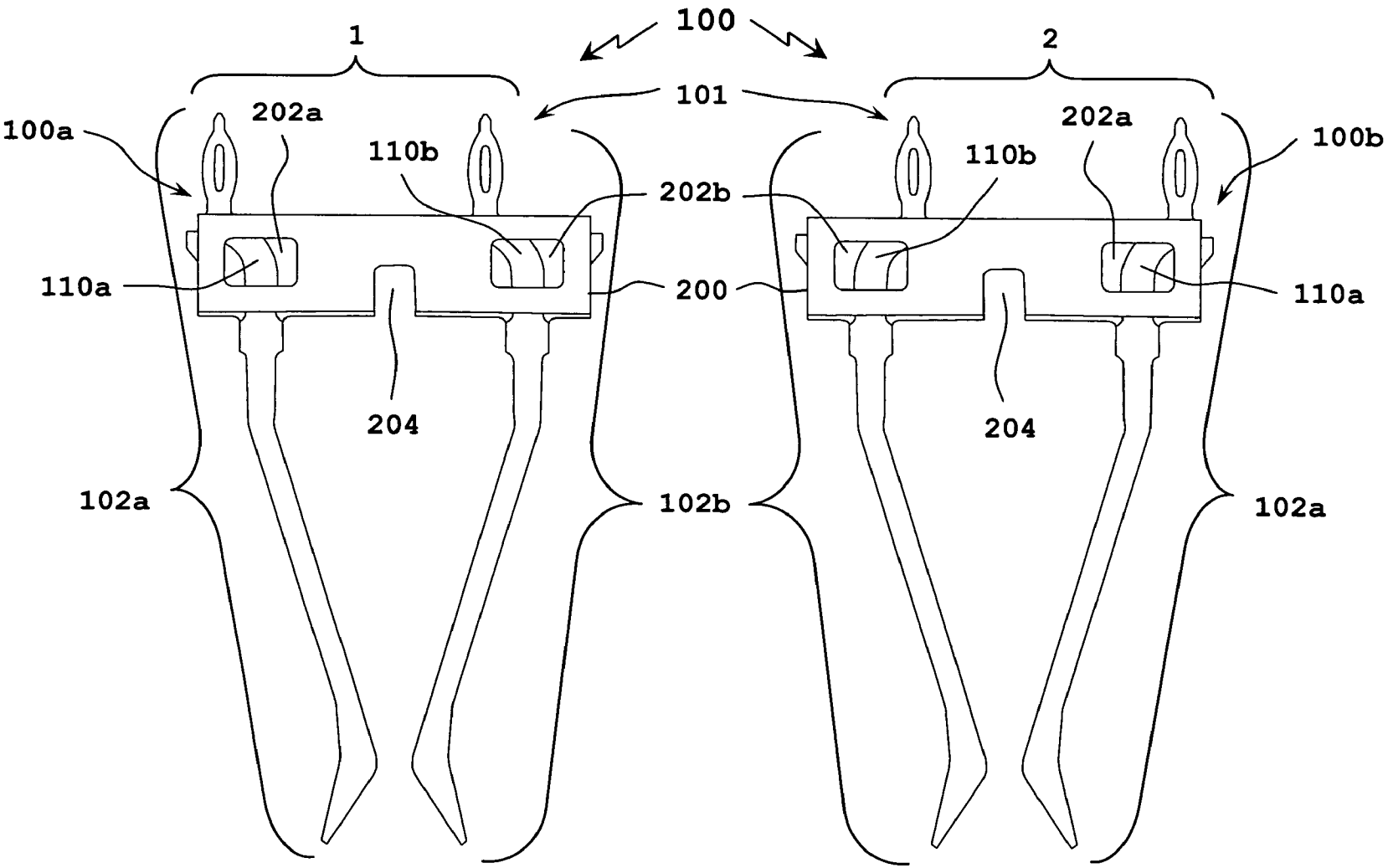
FIG. 2 is a side view of a set of two electrical contact assemblies according to the present disclosure.
Figure 3:
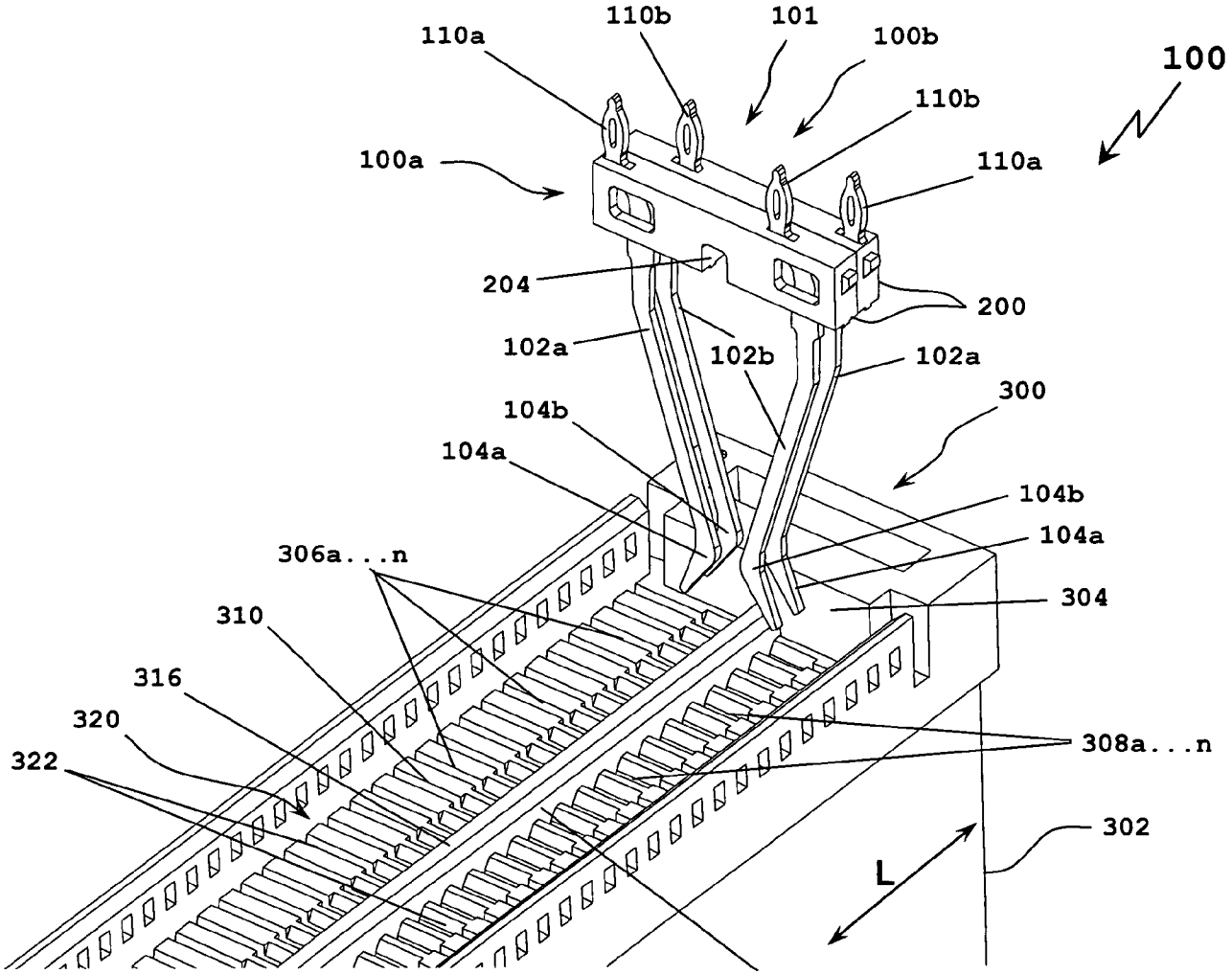
FIG. 3 is a perspective view of a set of electrical contact assemblies being inserted into an electrical connector assembly according to the present disclosure.
Figure 4:
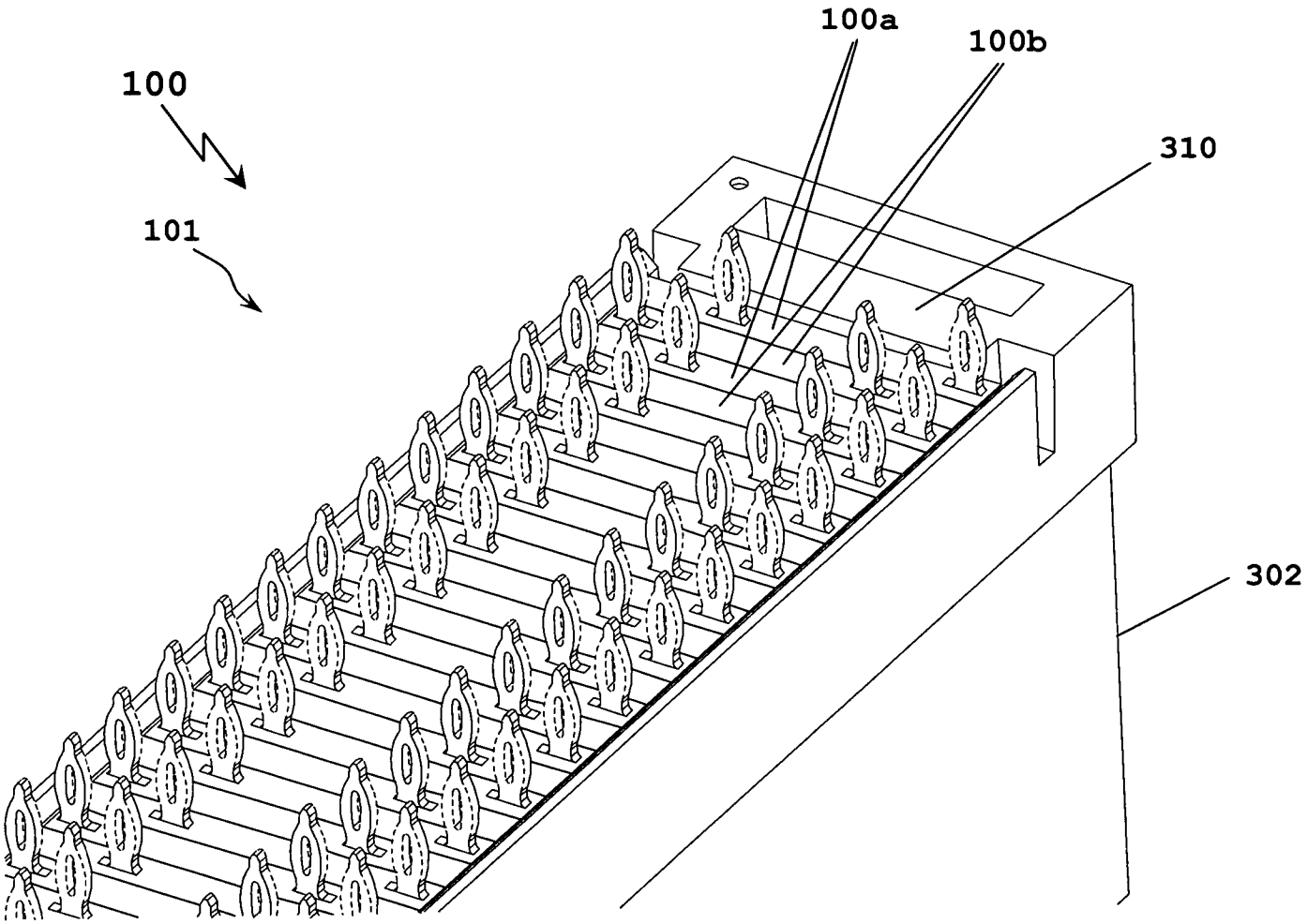
FIG. 4 is an enlarged partial perspective view of the electrical contact assemblies inserted into a top surface of the electrical connector assembly according to the present disclosure.
Figure 5:
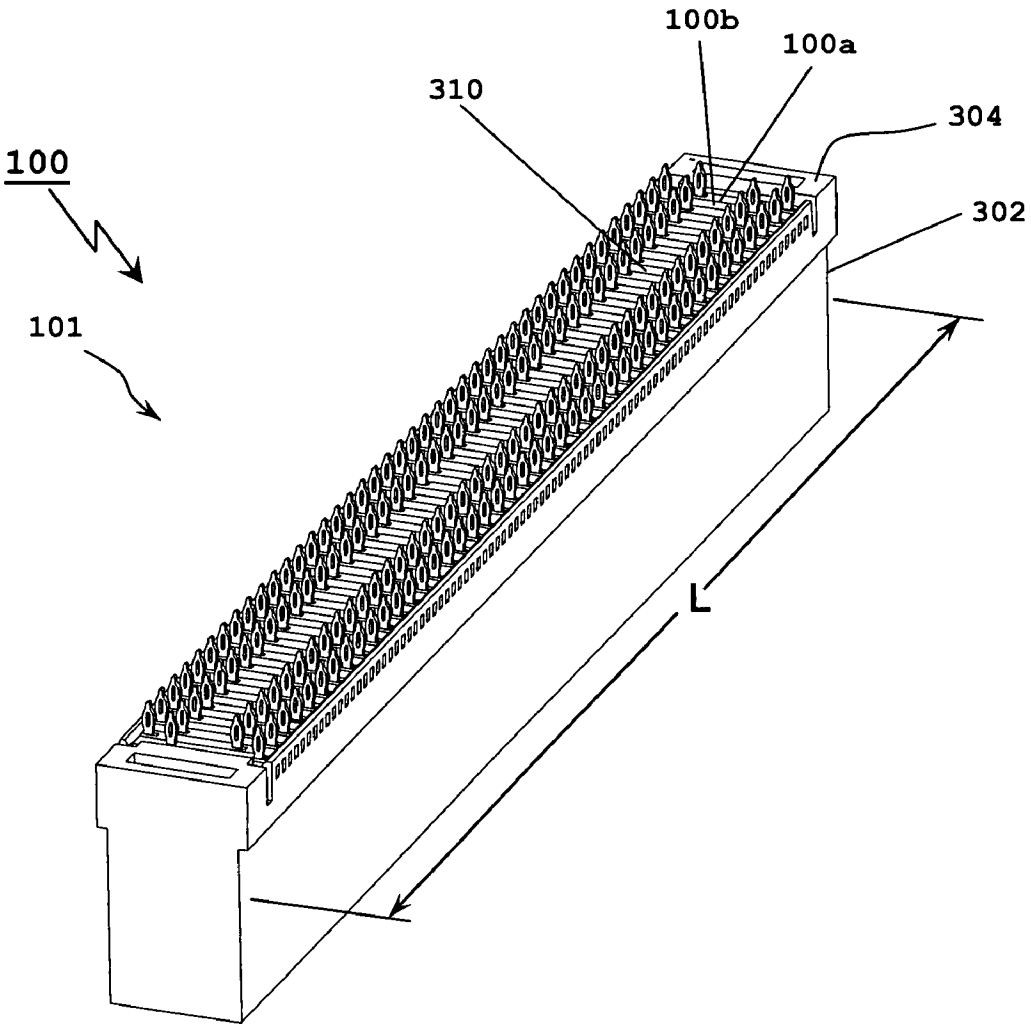
FIG. 5 is full perspective view of the electrical contact assemblies inserted into a top surface of the electrical connector assembly as illustrated in FIG. 4.
Figure 6:
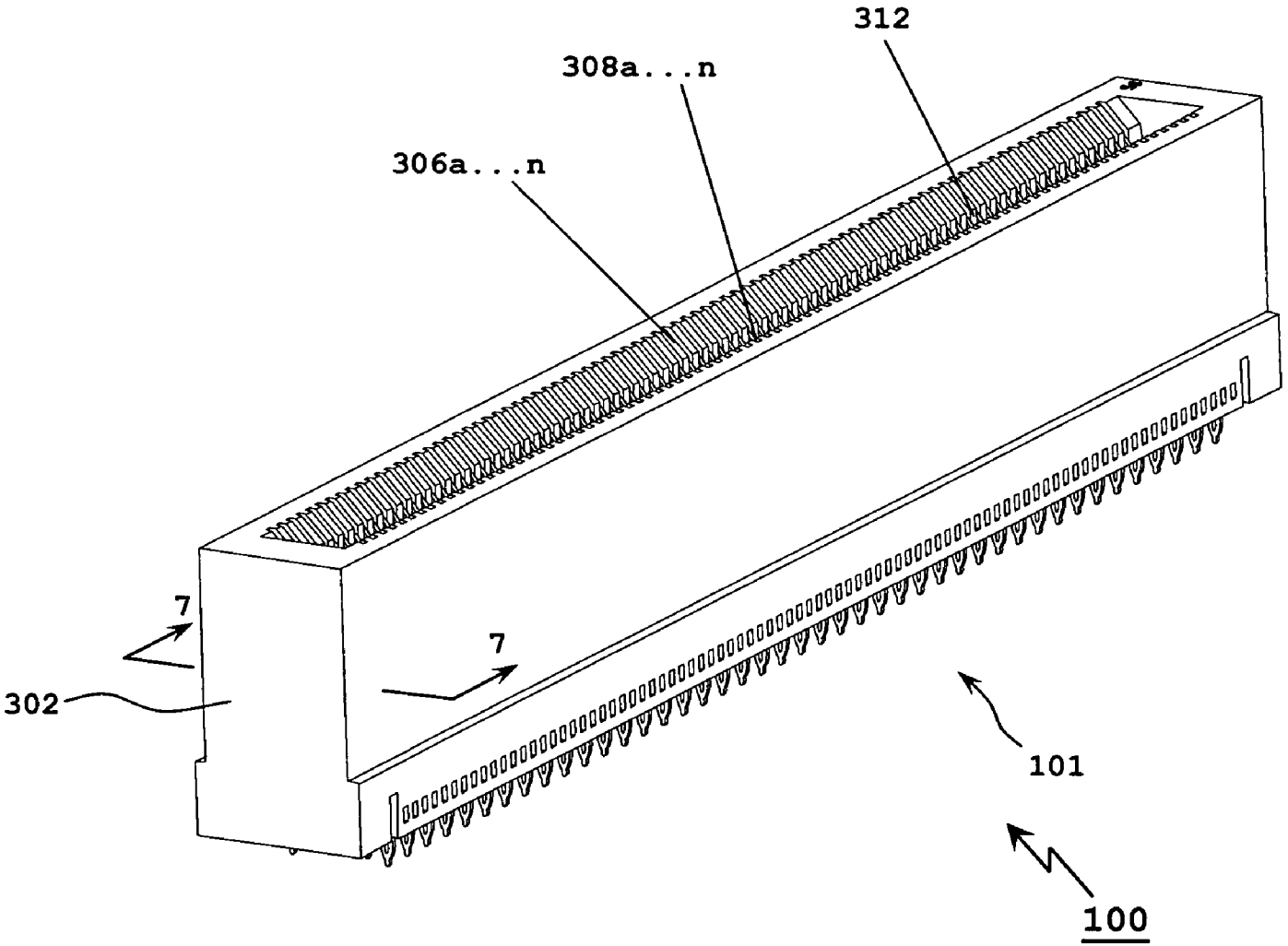
FIG. 6 is a perspective view of the electrical contact assemblies inserted into a bottom surface of the electrical connector assembly according to the present disclosure.
Figure 7:
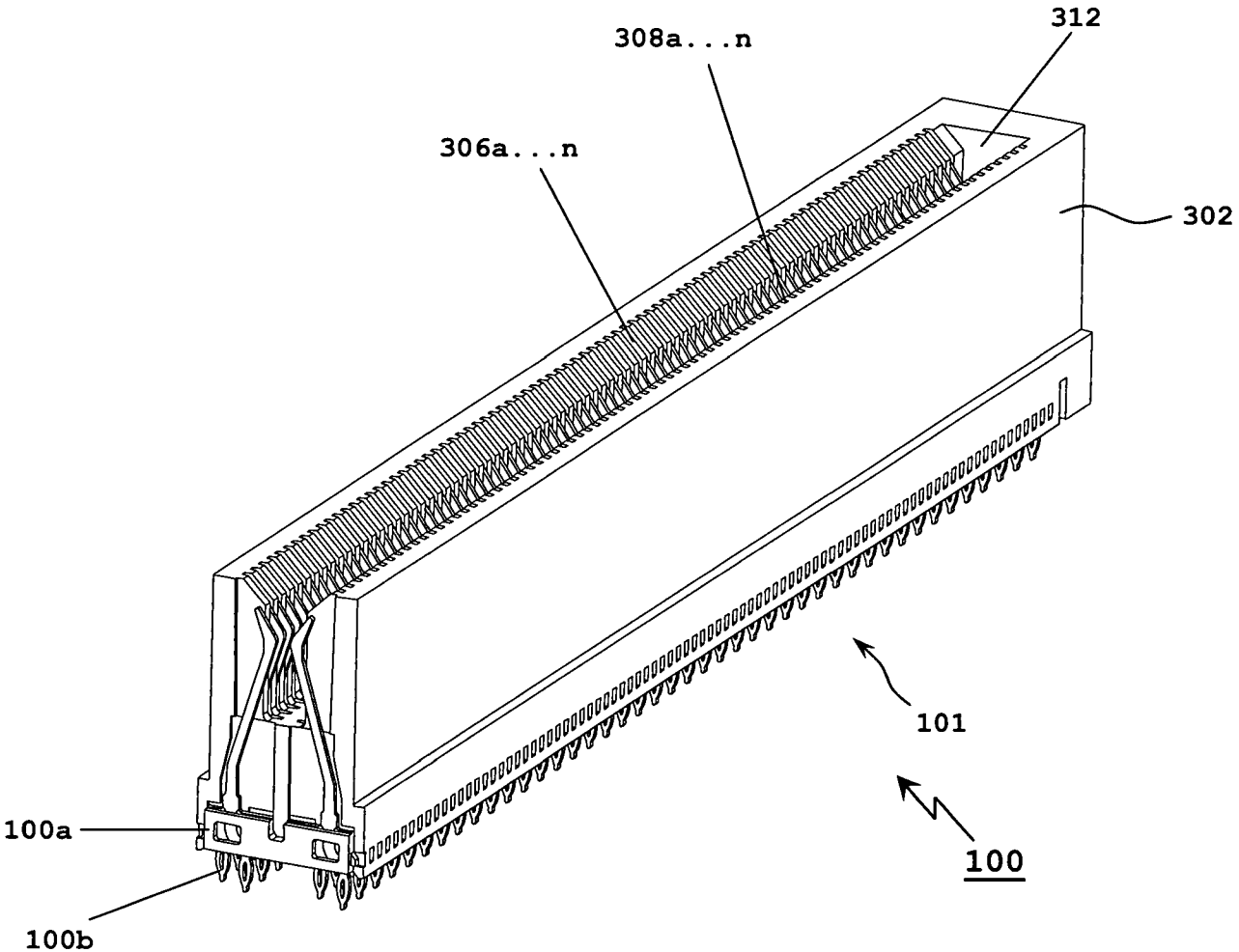
FIG. 7 is a perspective view of the end of the electrical connector assembly showing the electrical contact assemblies taken along cross-section line 7-7 of FIG. 6.

Referring to FIGS. 1-6, a plurality of sets 101 of substantially identical electrical contact assemblies according to an embodiment of the present disclosure are generally designated as 100. Each set 101 of electrical contact assemblies 100 includes a first pair 1 having a first electrical contact 102*a* and a second electrical contact 102*b*. The first pair 1 is arranged in a first orientation 100*a*. Each set 101 of substantially identical electrical contact assemblies 100 further includes a second pair 2 also having first electrical contact 102*a* and second electrical contact 102*b*. The second pair 2 is arranged in a second orientation 100*b*. As illustrated in FIGS. 1 and 2, the first pair 1 is arranged as a mirror image of the second pair 2. More particularly, the first pair 1 and the second pair 2 are rotated with respect to each other so that the orientation 100*b* of the second pair 2 is a reverse orientation with respect to the orientation 100*a* of the first pair 1.

The first and second electrical contacts 102*a* and 102*b* each include an edge connector portion 104*a*, 104*b* having a contact surface 106*a*, 106*b*, respectively. The first and second electrical contacts 102*a*, 102*b* each include a receptacle contact or press fit tail portion 110*a*, 110*b*, respectively. The receptacle contact portion 110*a*, 110*b* is in electrical communication with the edge connector portion 104*a*, 104*b*, respectively. The first and second electrical contacts 102*a*, 102*b* may each include an extending or contact beam portion 108*a*, 108*b* which may be predominantly linear and which extends from the edge connector portion 104*a*, 104*b* to the receptacle contact or press fit tail portion 110*a*, 110*b*, respectively. A manufacturing cut-off region 114*a*, 114*b* may be included within the extending or contact beam portion 108*a*, 108*b*, respectively. The extending or contact beam portion 108*a*, 108*b* is in electrical communication with the edge connector portion 104*a*, 104*b* and with the receptacle contact portion 110*a*, 110*b*.

The receptacle contact portions 110*a*, 110*b* are illustrated in FIG. 1 as compliant or press fit tail portions each of which has an aperture 112*a*, 112*b* disposed therethrough, respectively, which is compressed during insertion into a receptacle (not shown) of a printed circuit board (PCB) or other electrical device to establish electrical continuity with the PCB or other electrical device. The receptacle contact portions 110*a*,

110*b* may also include card edge contacts or pin or post contacts, or the like. The embodiments are not limited in this context.

The edge connector portion 104*a* of the first electrical contact 102*a* is substantially a mirror image of the edge connector portion 104*b* of the second electrical contact 102*b*. Similarly, the extending or contact mating beam portion 108*a* of the first electrical contact 102*a* is substantially a mirror image of the extending or contact mating beam portion 108*b* of the second electrical contact 102*b*. However, the receptacle contact or press fit tail portion 110*a* of the first electrical contact 102*a* is substantially a slide-along image of the receptacle contact or press fit tail portion 110*b* of the second electrical contact 102*b*.

The electrical contact assembly 100 further includes a joining member 200 joining the first electrical contact 102*a* to the second electrical contact 102*b*, thereby forming an integral unit. One aspect of the unit is that the receptacle contact portion 110*a* of the first electrical contact 102*a* is oriented substantially as a slide-along image of the receptacle contact portion 110*b* of the second electrical contact 102*b*.

In one embodiment, the joining member 200 joins the extending or contact beam portion 108*a* of the first electrical contact 102*a* to the extending or contact beam portion 108*b* of the second electrical contact 102*b* such that the receptacle contact portion 110*a* of the first electrical contact 102*a* is oriented substantially as a slide-along image of the receptacle contact portion 110*b* of the second electrical contact 102*b*. The joining member 200 may be a structural member such as an overmolding which may be made from an electrically insulating material such as a plastic, and which enables electrical insulation between the first and second electrical contacts 102*a* and 102*b*, respectively. The embodiments are not limited in this context.

The joining member 200 is configured such that the receptacle contact portions 110*a*, 110*b* are exposed thereby. In one embodiment, the joining member 200 may further include a recess 204 for mating to a surface of a housing of an electrical connector as discussed below. In addition, the overmolding or joining member 200 may further include at least one aperture, and typically at least two apertures 202*a*, 202*b*, disposed therethrough so as to expose at least a portion of the extending or contact mating beam portions 108*a* and 108*b*, respectively.

As illustrated in FIGS. 3-7, the present disclosure relates also to an electrical connector or electrical connector assembly 300 including a housing 302. The housing 302 includes first and second apertures 310 and 312 providing accessibility to an array of compartments 320. The housing 302 is configured to receive at least one set 101 of the substantially identical electrical contact assemblies 100 via the array 320 of partitioned electrically insulating adjacent compartments 322. The array 320 of partitioned compartments is subdivided into a first array 306*a* . . . n and a second array 308*a* . . . n which are electrically and mechanically separated from each other via a wall or partition 314 disposed substantially centrally along a length L of the housing 302, where "a" equals one and "n" equals a number greater than one. The wall or partition 314 includes a ridge or saddle member 316 also disposed substantially centrally along the length L. The recess 204 of the overmolding 200 engages with the ridge or saddle member 316 to provide a degree of stability for the electrical contact assemblies 100 when the electrical contact assemblies 100 are received by the housing 302.

The compartments 322 of the array 320 are configured to expose the receptacle contact portions 110*a*, 110*b* of the first and second electrical contacts 102*a*, 102*b* at the first aperture 310. As illustrated particularly in FIGS. 3-7, a plurality of contact assemblies 100 are arranged in sets 101 in sequence in a linear array such that the electrical contacts 102*a*, 102*b* of the plurality of contact assemblies 100 are arranged in the second orientation 100*b* which is a reverse orientation with respect to the first orientation 100*a* of an immediately preceding contact assembly 100 so as to expose the receptacle contact portions 110*a*, 110*b* of the electrical contact assemblies 100 in a staggered configuration with respect to the receptacle contact portions 110*b*, 110*a* of the immediately preceding contact assembly, respectively. The compartments 322 of the array 320 are configured to expose the edge connector portions 104*a*, 104*b* of the first and second electrical contacts 102*a*, 102*b* at the second aperture 312.

As a result of the foregoing, the electrical connector assembly 300 includes the housing 302, and at least one set 101 of substantially identical contact assemblies 100. In one embodiment, the housing 302 includes a plurality of the substantially identical contact assemblies 100. Each contact assembly 100 includes at least one of the pairs 1 or 2 of electrical contacts 102*a*, 102*b* with the receptacle contact portions 110*a*, 110*b* configured to be received by the housing 302. The plurality of contact assemblies 100 are arranged in sequence in a linear array in the housing 302. Each contact assembly 100 is arranged in the sequence in alternating first and second orientations 100*a*, 100*b*, respectively. The second orientation 100*b* is a reverse orientation with respect to the first orientation 100*a*.

Furthermore, the electrical connector assembly 300 includes the housing 302 holding a plurality of the sets 101 of identical contact assemblies 100 arranged in a linear array and in a reverse alternating sequence such that each successive contact assembly 100 in the array has a reverse orientation 100*b* with respect to an orientation 100*a* of an immediately preceding contact assembly 100.

Figure 8:
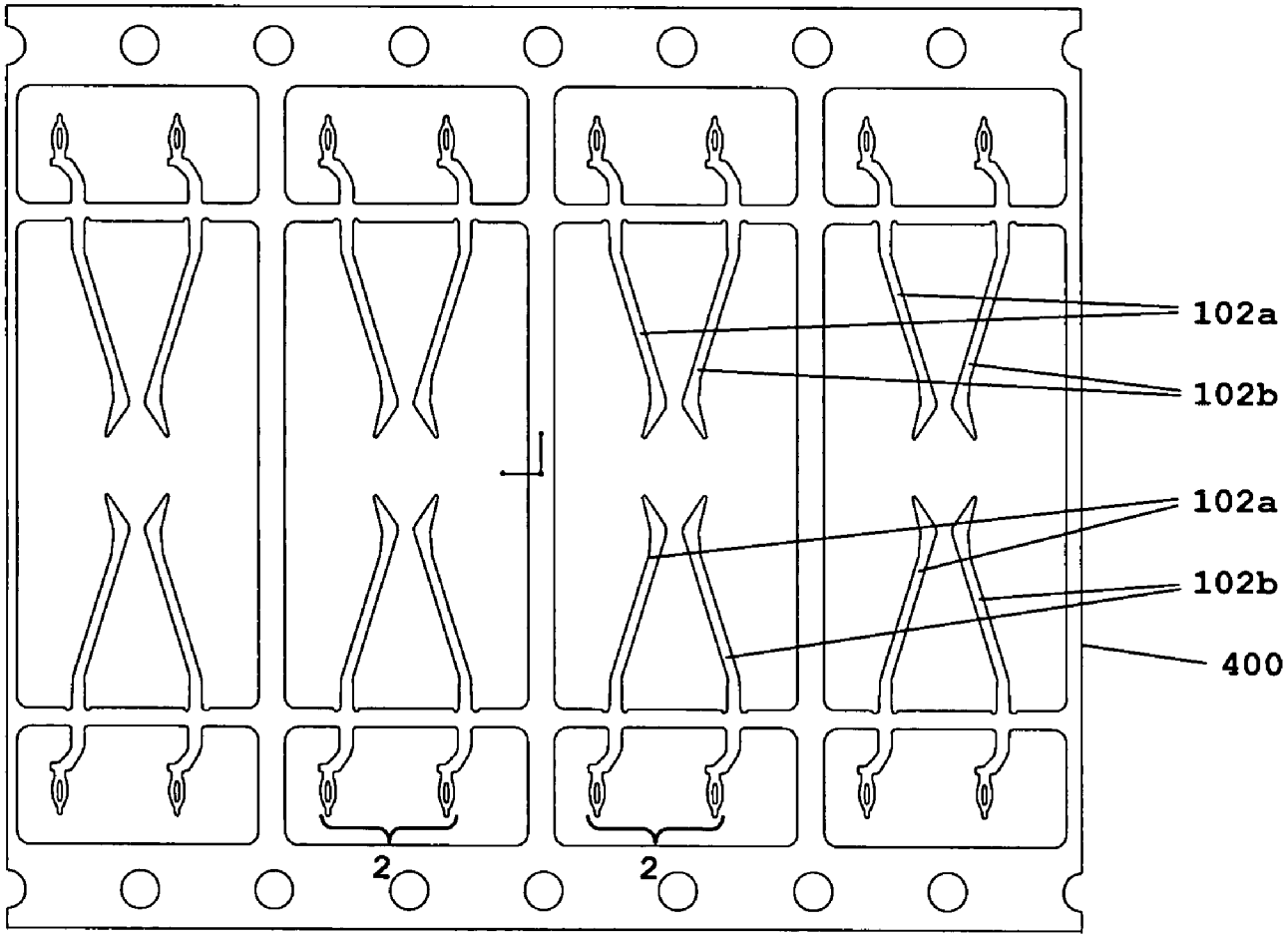
FIG. 8 is a plan view of a carrier strip during a portion of a manufacturing method for manufacturing multiple pairs of electrical contact assemblies according to the present disclosure.
Figure 9:
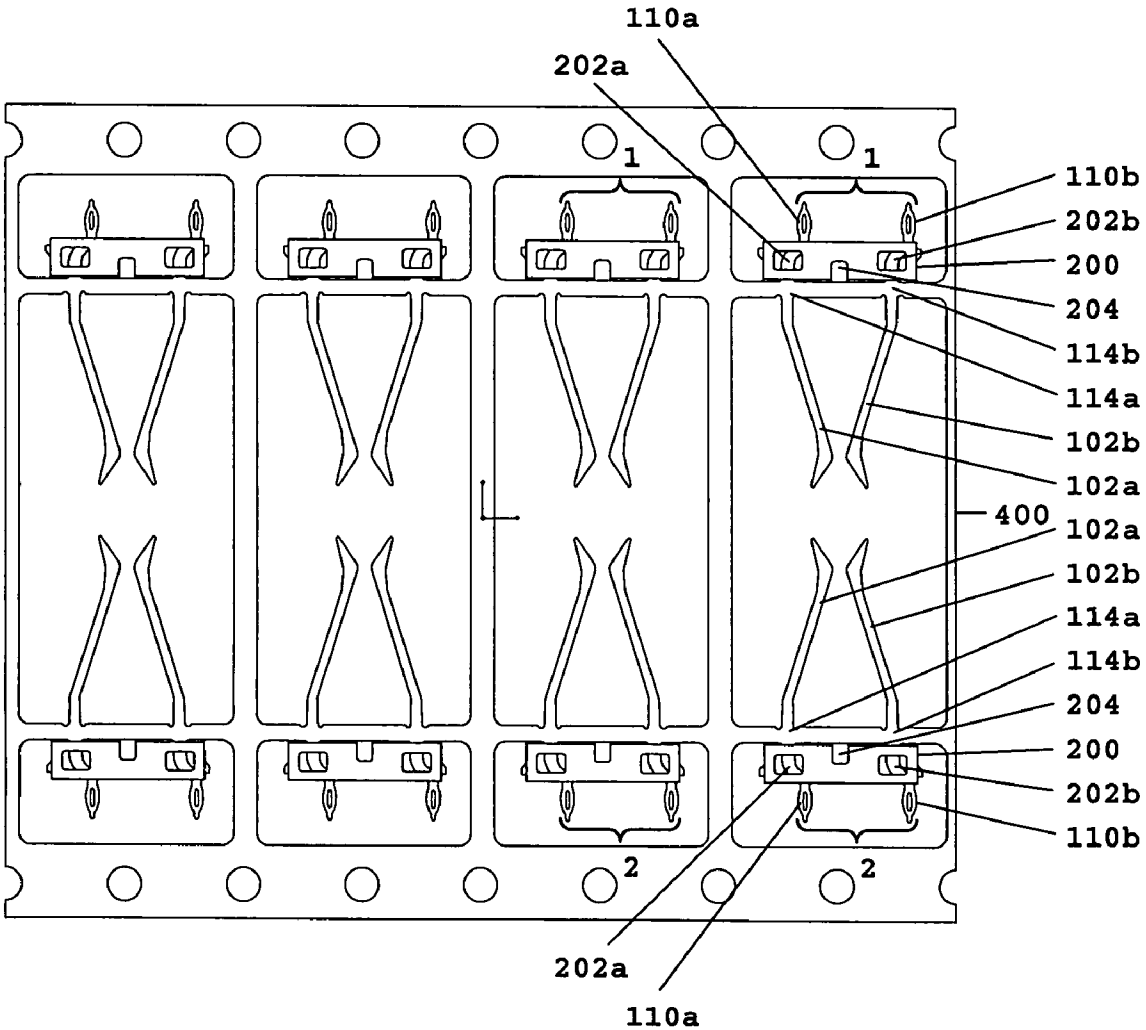
FIG. 9 is a plan view of the carrier strip during another portion of a manufacturing method for manufacturing multiple pairs of electrical contact assemblies according to the present disclosure.

FIGS. 8-9 disclose a method of manufacturing the electrical contact assembly 100. In particular, as illustrated in FIG. 8, the method includes the steps of providing a carrier strip 400, and stamping the carrier strip 400 to form at least a first electrical contact assembly 100. In one embodiment, the step of stamping the carrier strip is implemented by forming a multiplicity of the electrical contact assemblies 100. Each electrical contact assembly 100 includes first electrical contact 102*a* and second electrical contact 102*b*. The first electrical contact 102*a* is configured so that receptacle contact portion 110*a* is in electrical communication with the edge connector portion 104*a* (shown in FIG. 1). Similarly, the second electrical contact 102*b* is configured so that receptacle contact portion 110*b* is in electrical communication with the edge connector portion 104*b*. The first and second electrical contacts 102*a* and 102*b* are made from an electrically conductive material to provide electrical communication between the edge connector portions 104*a*, 104*b* and the receptacle contact portions 110*a*, 110*b*, respectively.

The edge connector portion 104*a* of the first electrical contact 102*a* is substantially a mirror image of the edge connector portion 104*b* of the second electrical contact 102*b*, while the receptacle contact portion 110*a* of the first electrical contact 102*a* is substantially a slide-along image of the receptacle contact portion 110*b* of the second electrical contact 102*b*. In one embodiment of the method, the first and second electrical contacts 102*a* and 102*b*, respectively, each include a contact beam or extending portion 108*a* and 108*b* (shown in FIG. 1), respectively, extending from the edge connector portion 104*a*, 104*b*, respectively. The extending portion 108*a*, 108*b* may provide the electrical communication between the edge connector portion 104*a*, 104*b* and the receptacle contact portion 110*a*, 110*b*, respectively. The extending portion 108*a* of the first electrical contact 102*a* may be substantially a mirror image of the extending portion 108*b* of the second electrical contact 102*b*.

The method of manufacturing may further include the step of joining the first electrical contact 102*a* together with the second electrical contact 102*b* to form an electrical contact assembly 100. In one embodiment, the step of joining the first electrical contact 102*a* together with the second electrical contact 102*b* is implemented by forming overmolding 200 over the first and second electrical contacts 102*a* and 102*b*, respectively. The overmolding 200 enables electrical insulation between the first and second electrical contacts 102*a* and 102*b*, respectively. In one embodiment, the method of manufacturing may further include the step of cutting the first electrical contact assembly 100 from the carrier strip 400 via the manufacturing cut-offs 114*a* and 114*b*. The method may further include the step of providing a recess 204 in the joining member or overmolding 200 for mating to ridge or saddle member 316 of the housing 302. The method of manufacturing may further include the step of providing at least one aperture 202*a*, and typically at least two apertures 202*a* and 202*b* disposed through the joining member or overmolding 200 so as to expose at least a portion of the receptacle contact portions 110*a*, 110*b*.

As can be appreciated from the foregoing disclosure, the embodiments of the present disclosure provide an electrical contact assembly which can be inserted in numerous quantities into an electrical connector, both of which are configured to reduce manufacturing and assembly costs. The disposition of the receptacle contact portions in a staggered configuration enables a savings in space for electrically communicating or mating to an electrical device which is intended to receive the receptacle contact portions.

The described embodiments of the present disclosure are intended to be illustrative rather than restrictive, and are not intended to represent every embodiment of the present disclosure. Various modifications and variations can be made without departing from the spirit or scope of the disclosure as set forth in the following claims both literally and in equivalents recognized in law.

What is claimed is:

1. An electrical connector assembly comprising:

a housing holding a plurality of identical electrical contact assemblies arranged in a linear array that extends along a longitudinal axis of the housing, each of the identical electrical contact assemblies being formed as an integral unit comprising first and second electrical contacts held by an insulative joining member, the plurality of identical electrical contact assemblies being arranged in a reverse alternating sequence in the housing such that each successive contact assembly in the linear array has a reverse orientation with respect to an immediately preceding contact assembly, wherein the identical electrical contact assemblies each comprise:

a first electrical contact and a second electrical contact, the first electrical contact having:

an edge connector portion; and a receptacle contact portion in electrical communication with the edge connector portion, the second electrical contact having:

an edge connector portion; and a receptacle contact portion in electrical communication with the edge connector portion, wherein the edge connector portion of the first electrical contact is a mirror image of the edge connector portion of the second electrical contact, and wherein the receptacle contact portion of the first electrical contact is a slide-along image of the receptacle contact portion of the second electrical contact.

2. The electrical connector assembly according to claim 1, wherein the first and second electrical contacts each comprise an extending portion extending from the edge connector portion, the extending portion providing the electrical communication between the edge connector portion and the receptacle contact portion.

3. The electrical connector assembly according to claim 1, wherein the joining member further comprises a recess for mating to a surface of the housing.

4. The electrical connector assembly according to claim 1, wherein the housing includes an array of partitioned electrically insulating adjacent compartments each holding one of the electrical contact assemblies.

5. The electrical connector assembly according to claim 4, wherein the housing comprises first and second apertures providing accessibility to the array of compartments.

6. An electrical connector assembly comprising:

a housing holding a plurality of identical electrical contact assemblies in a linear array that extends along a longitudinal axis of the housing, each of the identical electrical contact assemblies being formed as an integral unit comprising first and second electrical contacts held by an insulative joining member, the plurality of identical electrical contact assemblies being arranged in a reverse alternating sequence in the housing such that each successive contact assembly in the linear array has a reverse orientation with respect to an immediately preceding contact assembly.

7. The electrical connector assembly according to claim 5, wherein the compartments of the array are configured to expose the receptacle contact portions of the first and second electrical contacts at the first aperture.

8. The electrical connector assembly according to claim 7, wherein the receptacle contact portions of the electrical contact assemblies are exposed in a staggered configuration.

9. The electrical connector assembly according to claim 5, wherein the compartments of the array are configured to expose the edge connector portions of the first and second electrical contacts at the second aperture.

* * * * *